US007654407B1

(12) United States Patent
Obrecht et al.

(10) Patent No.: US 7,654,407 B1
(45) Date of Patent: Feb. 2, 2010

(54) GARBAGE CAN HOLDER

(76) Inventors: Bruce E. Obrecht, 21900 Brookside Cir., Glenwood, IA (US) 51534; Janet M. Obrecht, 21900 Brookside Cir., Glenwood, IA (US) 51534

( * ) Notice: Subject to any disclaimer, the term of this patent is extended or adjusted under 35 U.S.C. 154(b) by 800 days.

(21) Appl. No.: 11/288,538

(22) Filed: Nov. 29, 2005

(51) Int. Cl.
*B65D 25/22* (2006.01)
*A47G 23/02* (2006.01)
*A45F 3/44* (2006.01)

(52) U.S. Cl. ..... 220/475; 248/150; 248/156

(58) Field of Classification Search ..... 248/146, 248/156, 97, 105, 109, 155.3, 85, 96, 545
See application file for complete search history.

(56) References Cited

U.S. PATENT DOCUMENTS 3,091,342 A 5/1963 Crump ..... 211/71
3,173,547 A 3/1965 Alissandratos ..... 211/71
3,675,783 A * 7/1972 Reese ..... 211/85.19
4,513,938 A * 4/1985 Seymour ..... 248/507
4,559,474 A * 12/1985 Duret et al. ..... 315/3.6
4,559,757 A * 12/1985 Focke et al. ..... 53/176

* cited by examiner

*Primary Examiner*—Anthony Stashick
*Assistant Examiner*—Shawn M Braden
(74) *Attorney, Agent, or Firm*—Dennis L. Thomte; Thomte Patent Law Office LLC

(57) ABSTRACT

A garbage can holder including a tubular member which is embedded in the ground and has a garbage can holder mechanism vertically movably mounted therein between a lowered position and a raised position. When the garbage can holder mechanism is in its lowered position, the garbage can holder of this invention is not visible. When it is necessary to place garbage cans at curbside or the like, the garbage can holder mechanism is raised from its lower position to its upper position and the garbage cans are attached thereto and supported thereby.

2 Claims, 4 Drawing Sheets

GARBAGE CAN HOLDER

BACKGROUND OF THE INVENTION

1. Field of the Invention

This invention relates to a garbage can holder and more particularly to a garbage can holder which may be selectively moved from a buried or embedded position in the ground to a raised position to facilitate the attachment of garbage cans thereto. The garbage can holder prevents the garbage cans from being overturned by high winds, animals, etc.

2. Description of the Related Art

Homeowners are generally required to place their garbage at curbside to enable it to be collected. Some homeowners place their garbage in plastic sacks while others put their garbage in garbage cans and place the garbage cans at curbside. The garbage cans, if filled, tend to be displaced by high winds which may create a mess of garbage at curbside. If the garbage cans are empty, high winds may also cause the garbage cans to be moved onto neighbors' property or into the street causing hazardous driving situations.

In an effort to prevent the garbage cans from being displaced by high winds, some homeowners place their garbage cans in carts, which may also overturn. In other efforts to prevent the garbage cans from being displaced by high winds or like, permanent fixtures or holders are sometimes placed at curbside, but they detract from the aesthetic appearance of the property due to the fact that they are visible even though garbage cans are not positioned therein or thereon and create an obstacle to snow removal and lawn mowing operations.

SUMMARY OF THE INVENTION

A structure is provided for selectively holding a garbage can having spaced-apart side handles. The structure of this invention includes an elongated, hollow, vertically disposed tubular member, having upper and lower ends, which is positioned within the ground so that its upper end is positioned adjacent ground level. A garbage can holder assembly, having upper and lower ends, is positioned within the tubular member and is selectively vertically movable between a first retracted position with respect to the tubular member and a second extended position with respect to the tubular member. The upper end of the garbage can holder assembly, when the garbage can holder assembly is in its retracted position, is received by the upper end of the tubular member. The garbage can holder assembly includes an attachment mechanism below the upper end thereof so that one of the side handles of a pair of garbage cans may be attached thereto to maintain the garbage can adjacent the garbage can holder assembly when the garbage can holder assembly is in its extended position. Preferably, a cover is secured to the upper end of the garbage can holder assembly which closes the upper end of the tubular member when the garbage can holder assembly is in its retracted position. Preferably, first and second supports are pivotally secured to the garbage can holder assembly, below the attachment mechanism, which are selectively movable from a stored position to an operative position so that the supports will engage the sides of the garbage cans when in their operative positions.

When it is desired to place garbage cans at curbside, the garbage can holder assembly is moved upwardly with respect to the tubular member so that the garbage cans may be secured thereto. When the garbage cans have been emptied, the garbage cans may be stored at a position remote from the structure and the garbage can holder assembly is retracted within the tubular member so that the structure is not visible when not being used.

It is therefore a principal object of the invention to provide an improved garbage can holder assembly.

A further object of the invention is to provide a garbage can holder assembly which, when not being used, is in a retracted position within the ground and which may be moved upwardly therefrom so that garbage cans may be secured thereto.

Still another object of the invention is to provide a garbage can holder which is movable from visible to invisible positions.

Still another object of the invention is to provide a garbage can holder which may be embedded in the ground at curbside and which may be raised so that garbage cans may be secured thereto to prevent the garbage cans from being displaced therefrom during high winds or the like.

These and other objects will be apparent to those skilled in the art.

DETAILED DESCRIPTION OF THE INVENTION

Figure 1:
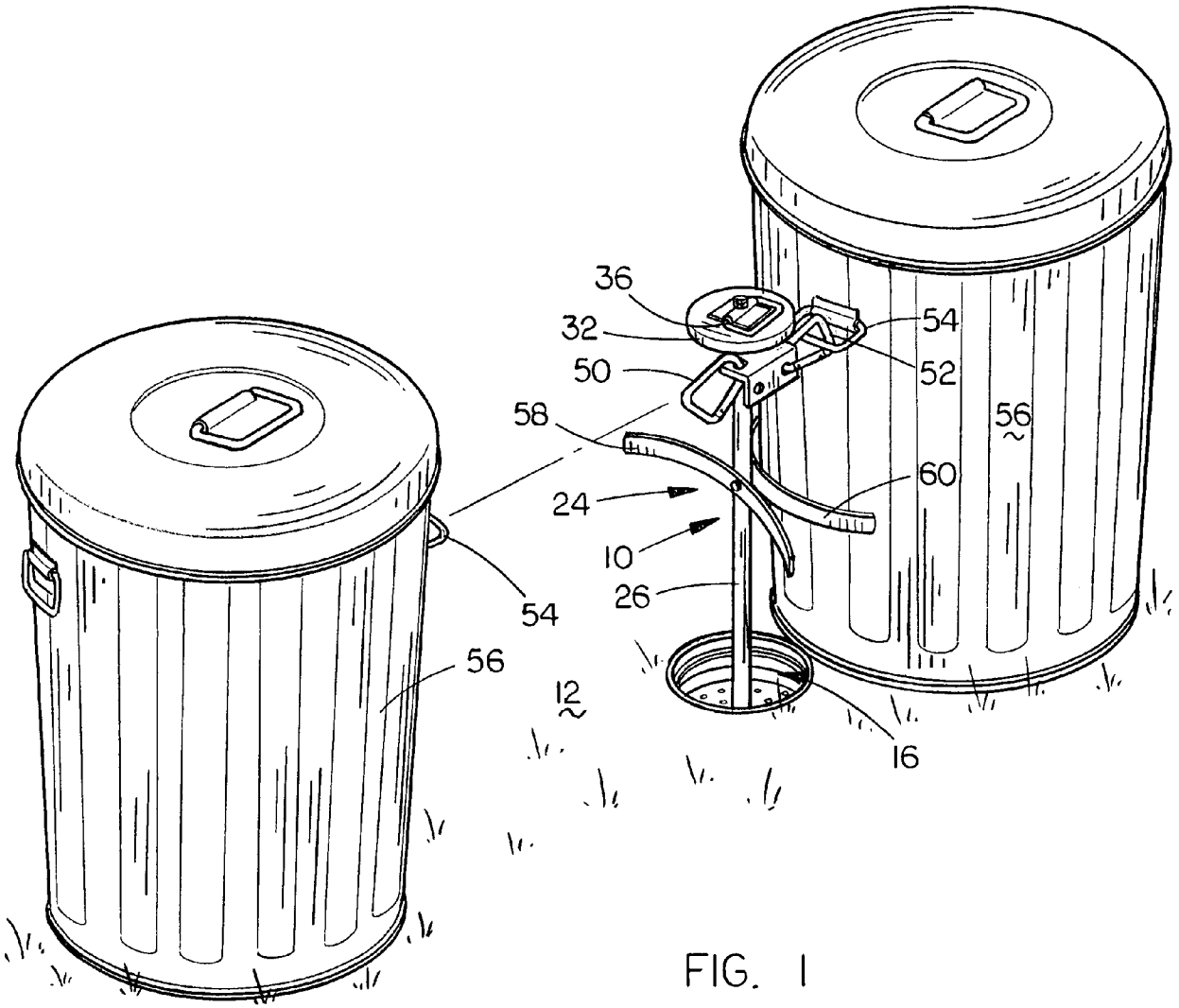
FIG. 1 is a perspective view of the garbage can holder of this invention in its raised or extended position.

The numeral 10 refers generally to the garbage can holder assembly of this invention which is designed to be embedded in the ground 12 which has a ground level 14. Garbage can holder assembly 10 includes an elongated, vertically disposed, tubular member 16 having an open upper end 18 and preferably an open lower end 20. Tubular member 16 is preferably comprised of a plastic material and preferably has a diameter of three to four inches. The upper end 18 of tubular member 16 is provided with an enlarged diameter portion 22.

Figure 4:
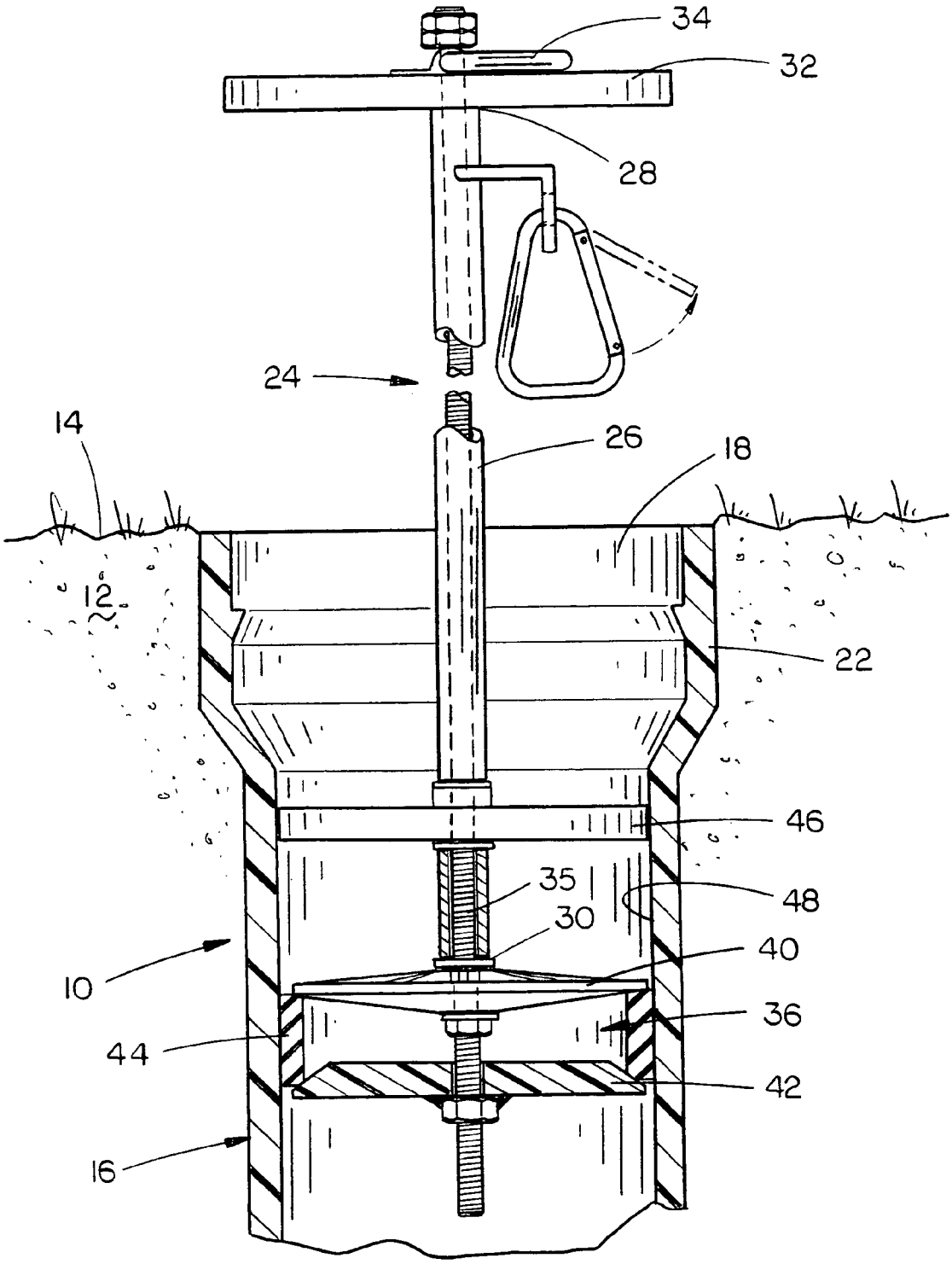
FIG. 4 is a partial vertical sectional view of the garbage can holder in its extended position.

The numeral 24 refers generally to a garbage can holder mechanism which is selectively vertically movably mounted within tubular member 16. The mechanism 24 includes an elongated shaft or tube 26 having an upper end 28 and a lower end 30. Preferably, a cover or lid 32 is mounted at the upper end 28 of shaft 26 and has a foldable handle 34 provided thereon. As seen, the lid or cover 32 is adapted to be received within the enlarged upper portion 22 of the tubular member 16. An elongated, threaded rod 35 is positioned in shaft 26, as seen in FIG. 4. Handle 34 is operably secured to the upper end of rod 35 whereby handle 34 may be rotated to cause the rotation of rod 35 with respect to shaft 26.

The numeral 36 refers to a retainer mechanism which is mounted on the lower end 30 of the rod 35 and which may be expanded by rotating rod 35 with respect to shaft 26 so as to yieldably and frictionally engage the inner surface 38 of tubular member 16 to maintain the mechanism 24 in its upper or raised position. The retainer mechanism 36 includes a fixed upper member 40, a movable lower member 42, and a gasket 44 which is compressed and expanded when rod 35 is rotated with respect to shaft 26 to cause member 42 to be moved upwardly on rod 35 to expand gasket 44 outwardly into frictional engagement with the interior surface of tubular member 16. Rotation of rod 35 in the opposite direction with respect to shaft 26 permits gasket 44 to contract out of frictional engagement with tubular member 16. The numeral 46 refers to a stabilizer which is mounted at the lower end of shaft 26 above member 40 and which is adapted to engage the inner surface 48 of tubular member 16 to maintain the mechanism 24 in an upright position when the mechanism 24 has been moved to its upper position.

The numerals 50 and 52 refer to connectors which are secured to the shaft 26 below the upper end thereof and which are adapted to be secured to the handles 54 of a garbage can or cans 56.

Figure 2:
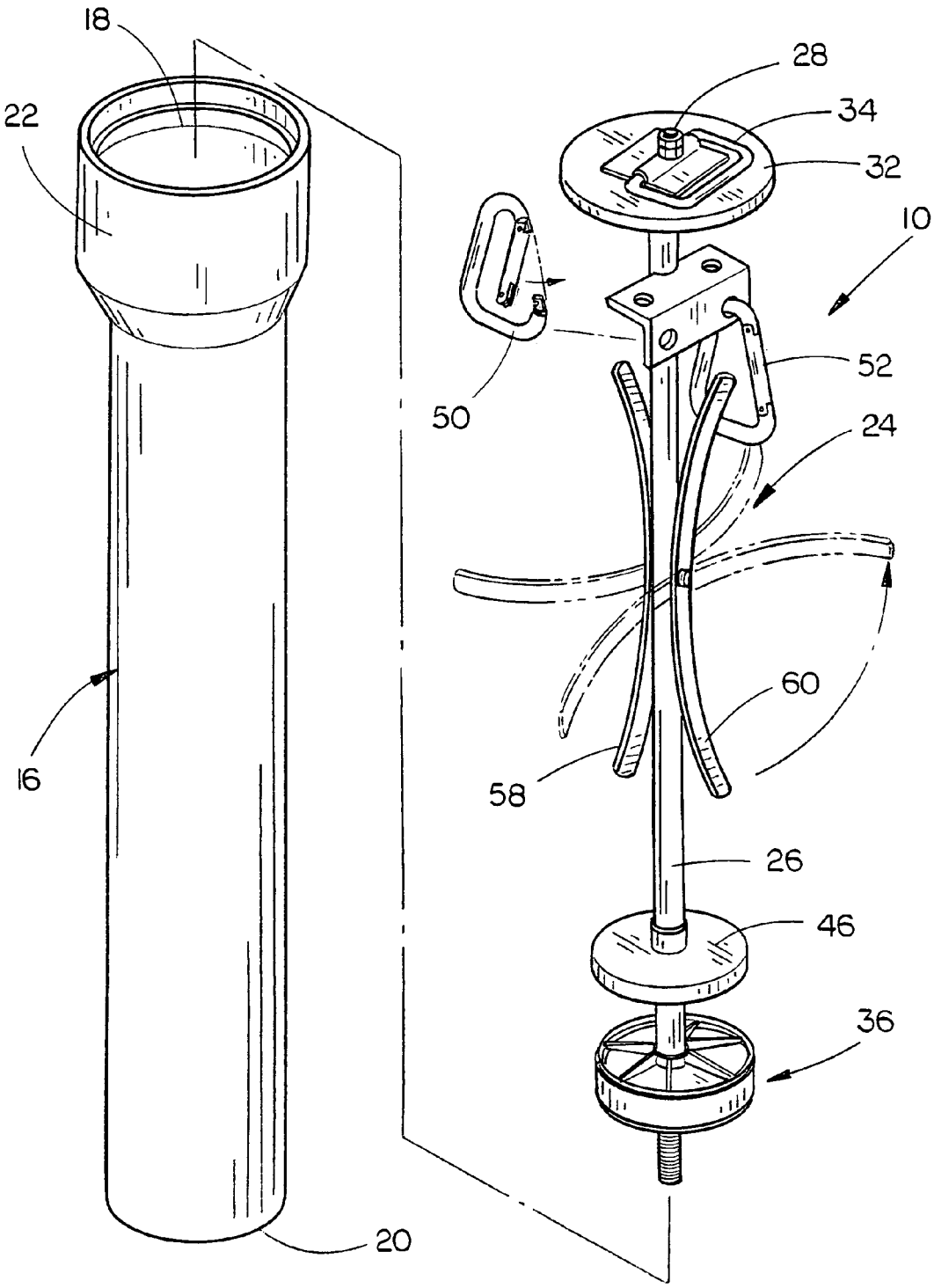
FIG. 2 is an exploded perspective view of this invention.

It is also recommended that a pair of elongated braces or supports 58 and 60, which are arcuate in shape, be pivotally secured to shaft 26 at 62 so that the supports 58 and 60 may be moved to a substantially vertically disposed position when the mechanism is to be moved to its lowered or inoperative position (FIG. 2) or which may be pivotally moved so as to be horizontally disposed, as viewed in FIG. 1, to engage the sides of garbage cans positioned adjacent thereto.

In use, the tubular member 16 will be preferably embedded in the ground so that the upper end thereof is positioned slightly below ground level 14. When the mechanism 24 is in its retracted position, the cover or lid 32 closes the upper end of the tubular member 16. It is also recommended that pea gravel or the like be placed below the tubular member 16 to provide drainage for water should rainwater enter the upper end of the tubular member 16 when the mechanism 24 is in its extended position.

Figure 3:
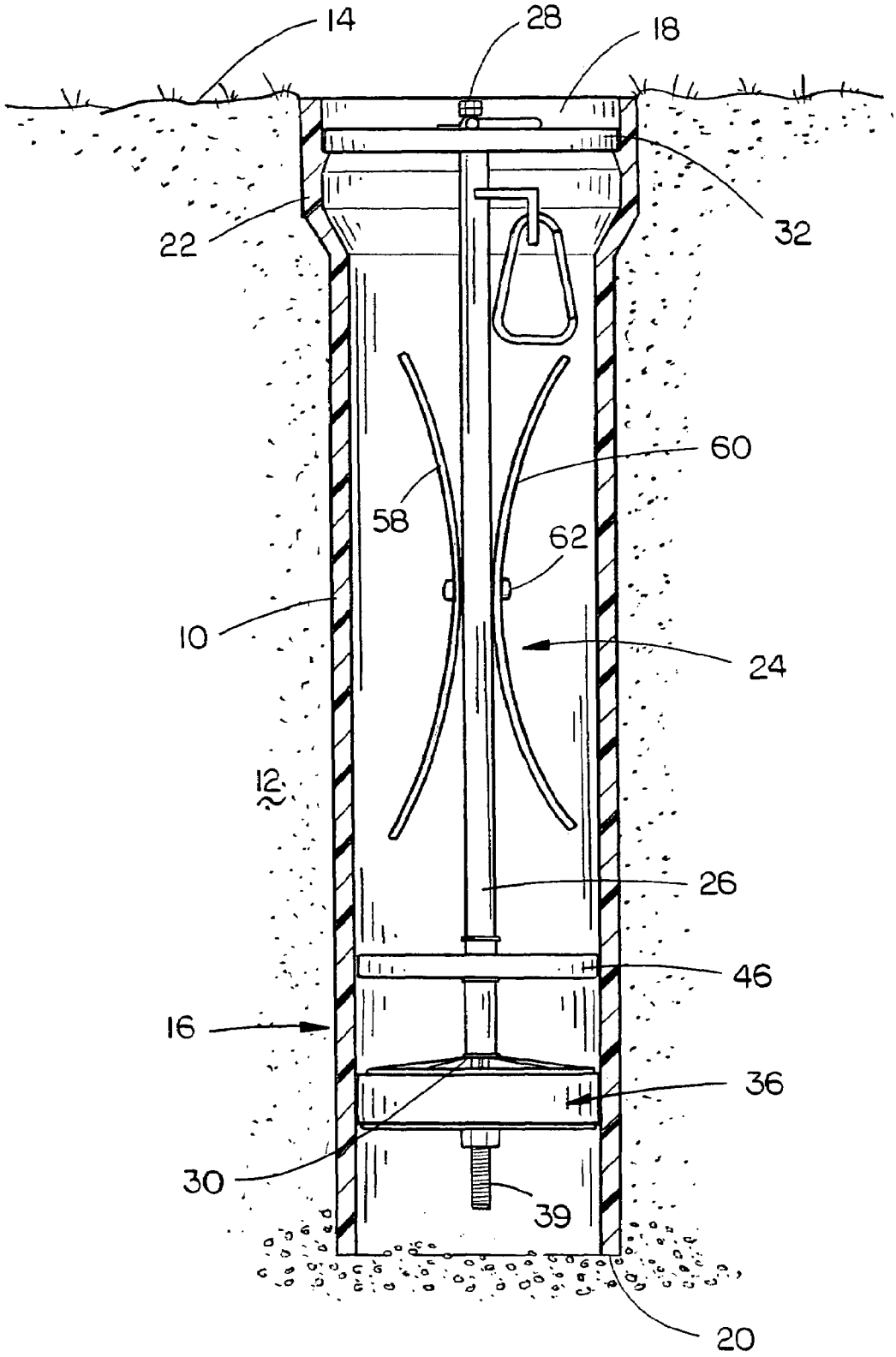
FIG. 3 is a vertical sectional view of the garbage can holder in its retracted or lowered position.

When the mechanism 24 is in its lowered position (FIG. 3), the presence of the garbage can holder 10 will not be noticed and will not interfere with lawn mowing or snow removal operations. When it is desired to place garbage cans at curbside or the like, the mechanism 24 is moved from the position of FIG. 3 to the position of FIGS. 1, 4. The mechanism 36 yieldably maintains the mechanism 24 in its upper position so that the garbage can handles may be connected to the attachments 42 and 44, respectively. The supports 50 and 52 are also pivotally moved from their vertically disposed position to their horizontally disposed position so that they are able to engage the sides of the garbage cans to assist in maintaining the garbage cans in position.

When the garbage cans have been emptied, the garbage cans may be moved inside or the like and the mechanism 24 is then lowered downwardly into the tubular member 16 until such time as the next garbage collection arrives.

Thus it can be seen that a novel garbage can holder has been provided which enable garbage cans to be prevented from being displaced by high winds, animals or the like. When the garbage can holder is not being used, the mechanism 24 will be in its retracted position so as to not interfere with the aesthetic appearance of the homeowners' property.

Thus it can be seen that the invention accomplishes at least all of its stated objectives.

We claim:

1. A structure for selectively holding a garbage can above ground with the garbage can having spaced-apart side handles, comprising:

an elongated, hollow, vertically disposed tubular member, having upper and lower ends, positioned within the ground so that its said upper end is positioned adjacent ground level;

a garbage can holder assembly, having upper and lower ends, positioned within said tubular member and being selectively vertically movable between a first retracted position with respect to said tubular member and a second extended position with respect to said tubular member;

said upper end of said garbage can holder assembly, when said garbage can holder assembly is in its said retracted position, being received by said upper end of said tubular member;

said garbage can holder assembly including an attachment mechanism below said upper end thereof so that one of said side handles of a garbage can may be attached thereto to maintain the garbage can adjacent said garbage can holder assembly when said garbage can holder assembly is in its said extended position;

a first elongated and curved support pivotally secured, intermediate its length, to said garbage can holder assembly, below said attachment mechanism, which is selectively movable from a stored position to an operative position;

said first support adapted to partially embrace and engage the side of a garbage can when in its said operative position.

2. The structure of claim 1 wherein a second elongated and curved support is pivotally secured, intermediate its length, to said garbage can holder which is selectively movable from a stored position to an operative position and which is adapted to partially embrace and engage the side of a garbage can when in its said operative position.

* * * * *